United States Patent [19]

Fisher

[11] 4,345,853

[45] Aug. 24, 1982

[54] LIGHT WEIGHT RUN-OFF TROUGH

[76] Inventor: Stanley P. Fisher, 10110 Walker Lake Dr., Great Falls, Va. 22066

[21] Appl. No.: 175,538

[22] Filed: Aug. 5, 1980

[51] Int. Cl.[3] ..... E04D 13/08; E02B 9/04

[52] U.S. Cl. ..... 405/119; 52/16

[58] Field of Search ..... 405/119-123; 52/11, 16; 403/191, 234, 237; 138/103; 404/2

[56] References Cited

U.S. PATENT DOCUMENTS

| | | | |
|---|---|---|---|
| 3,048,983 | 8/1962 | Crummel | 405/119 |
| 3,060,952 | 10/1962 | Bystrom | 52/16 X |
| 3,084,479 | 4/1963 | Struber | 52/16 X |

*Primary Examiner*—Price C. Faw, Jr.

*Assistant Examiner*—Nancy J. Pistel

*Attorney, Agent, or Firm*—Oblon, Fisher, Spivak, McClelland & Maier

[57] ABSTRACT

A light weight hollow run-off trough which can be secured to a down spout while being substantially supported by the ground is disclosed. The trough includes a depression adjacent its rear end for accommodating the distal end of the down spout. The trough body is formed of a resiliently deformable molded plastic and the rear wall thereof includes a separable portion having the shape of an inverted T. In use, the distal end of the down spout is inserted into the depression and the inverted T shaped portion is bent by 180°, and the arms thereof are wrapped around a vertical portion of the down spout, and tied.

10 Claims, 6 Drawing Figures

LIGHT WEIGHT RUN-OFF TROUGH

BACKGROUND OF THE INVENTION

1. Field of the Invention

The present invention relates to a run-off trough for a down spout associated with a gutter for a house or building. More particularly, the present invention relates to a light-weight hollow run-off trough.

2. Description of the Prior Art

It has been well known in the art to provide the down spouts of gutters with run-off troughs for carrying the run-off water away from the house or building. Traditionally, such run-off troughs have been formed of a block of dense material such as concrete with a trough-like depression in the top surface thereof. The rear end of the trough was placed below the outlet at the distal end of a down spout and the trough carried the run-off water from rain or melting snow away from the house.

Recently, light-weight run-off troughs have been developed which have been formed from a thin sheet of molded plastic material having an outer configuration in the form of the traditional concrete run-off trough. These light weight run-off troughs were far easier to handle and transport than the traditional troughs, and were easily stacked, but had the problem of instability. That is, due to their light weight, these hollow plastic troughs tended to move about or be blown away during a storm. Securement structures have been developed for securing such light weight troughs to the ground, such as spikes which can be driven into the ground and which include portions for affixing to the trough so as to hold the trough firmly on the ground below the distal end of the down spout. However, such spikes tended to loosen when the ground was soaked following a rain, and their ability to secure the run-off trough was therefore limited.

Attempts have also been made to attach the run-off trough to the end of the down spout. An example of such an attempt may be found in U.S. Pat. No. 3,084,479. In this patent, the run-off trough was secured to, and held by, the distal end of the down spout, by means of a screw passing through both the down spout and the trough. However, these troughs have also been found to be unsatisfactory for several reasons. First, the run-off trough was manufactured and supplied with the down spout itself so that they could not normally be separately purchased. Further, the attachment of the trough to the down spout required modifications to the distal end of the down spout as well as the need for tools such as drills. Finally, because the trough was held and supported by the down spout, it could weaken the down spout and possibly cause the down spout to become detached from the gutter. That is, if the trough became clogged with leaves, for example, following a rain, water could subsequently build up in the trough and the weight of the water would be transferred to the supporting down spout, thereby stressing the down spout supports.

SUMMARY OF THE INVENTION

It is an object of the present invention to provide a run-off trough which is light in weight and easily transportable.

It is a further object of the present invention to provide a run-off trough which can be secured to a down spout.

It is a further object of the present invention to provide a run-off trough which can be attached to any down spout.

It is a further object of the present invention to provide a run-off trough which can be secured to a down spout without alteration of the down spout.

It is a final object of the present invention to provide a run-off trough which is secured to a down spout but which is at least partially supported by the ground.

In accordance with the above objects, the present invention is formed of a hollow, molded plastic block having a trough in the top surface thereof for accommodating the run-off water. The trough in the top surface of the block has a substantially vertical rear surface and side surfaces. The rear surface of the trough includes a depression extending therefrom and towards the rear end of the block. The depression has a shape which substantially conforms to the shape of the distal end of the down spout. In use, the distal end of the down spout is at least partially inserted into the depression which closely surrounds the distal end of the down spout. Therefore, the walls of the depression substantially hold the block in position with respect to the down spout for preventing movement of the down spout.

According to the present invention, the block includes a substantially vertical rear surface. This rear surface includes a portion in the form of an inverted T which can be separated from the remainder of the rear surface except at the base of the T. In use, once the block is positioned with the distal end of the down spout in the depression, the inverted T shaped portion of the rear surface of the block is bent 180° at the base of the inverted T, the block being formed of a resiliently deformable plastic. The arms of the T, which is no longer inverted, therefore extend behind a vertical portion of the down spout and are wrapped around the vertical portion. Securement means, such as tie strings passed through holes in the ends of the arms of the T, are then used to tie the ends of the arms together with a vertical portion of the down spout being enclosed by the arms of the T.

The present invention therefore has several advantages over the prior art. The entrainment of the end of the down spout within the depression adjacent the trough, coupled with the tieing of the arms of the T about a vertical portion of the down spout securely holds the run-off trough in position below the down spout. Further, the run-off trough can be attached to an already existing down spout and need not be purchased together with the down spout. It can also be seen that the attachment of the trough to the down spout does not require any alteration of the down spout, or any tools.

The run-off trough of the present invention is also advantageous in that it is at least partially supported by the ground. If the trough becomes clogged and the resulting water build up increases the weight of the trough, the trough simply slides down, with the wrapped arms of the T sliding along the vertical portion of the down spout, until the base of the trough is firmly supported by the ground. Accordingly, excessive stresses are not placed upon the supports for the down spout. Yet another advantage of the present invention is that the resilience of the plastic material of the trough causes the trough to tend to straighten out about the bent base of the inverted T, so that the front end of the trough is firmly pressed against the ground. This prevents the possibility of a gust of wind lifting the end of the trough during a storm.

The distal ends of down spouts are separated from the ground by varying distances. Therefore, according to a further feature of the present invention, the troughs of the present invention may be manufactured to have several different lengths for the base of the inverted T; troughs having longer bases for the inverted T can be used for those down spouts which are separated from the ground by a relatively great distance, while troughs having an inverted T including a relatively short base may be used with those down spouts which extend to a point fairly close to the ground. Optionally, it may be possible to extend the bottom of the rear surface of the block which is associated with the inverted T, below the level of the remainder of the rear surface of the block so that, following inversion, the arms can extend sufficiently far enough off the ground to surround a vertical portion of a down spout.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 5:
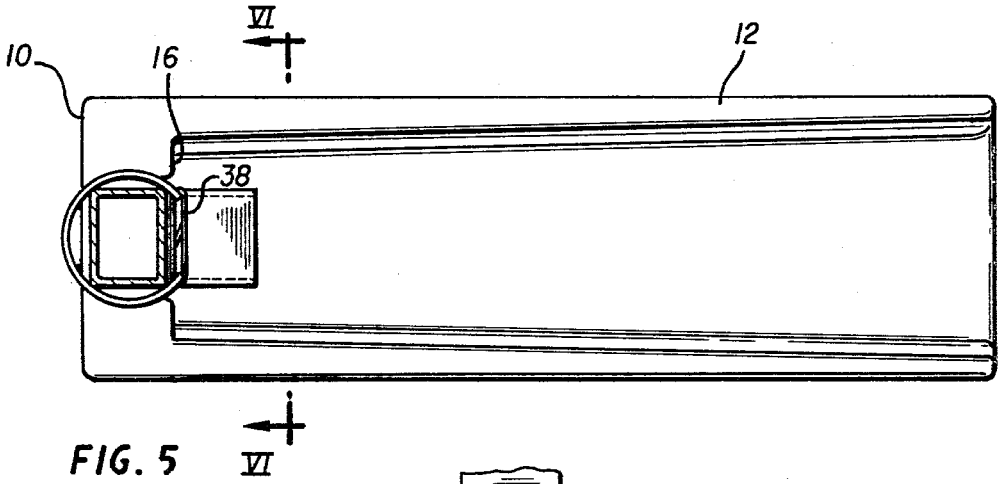
FIG. 5 is a top view of the run-off trough of FIG. 4.
Figure 6:
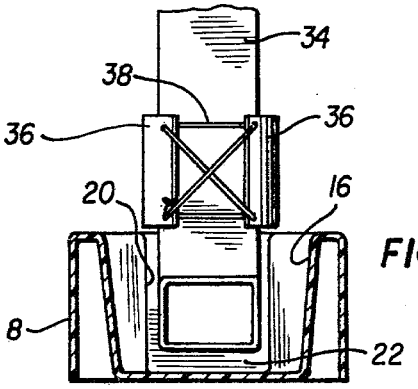
FIG. 6 is a view taken along the cut shown as VI—VI in FIG. 5.

As seen in the figures, the run-off trough of the present invention is formed of a thin sheet of molded plastic material forming a hollow body 2. The hollow body 2 is preferably substantially rectangular and slightly tapered from the back 4 towards the front 6, although other shapes are possible. The hollow body includes substantially vertical side walls 8 and rear wall 10 as well as a substantially horizontal (but slightly tapered) top surface 12. The top surface 12 has a depression therein which forms the trough for the run-off water. The trough includes a bottom surface 14 as well as a substantially vertical rear surface 16 (see FIGS. 5 and 6).

The top surface 12 of the body also includes a depression 18 extending from the rear surface of the trough towards the back wall 10. The depression 18 preferably extends to a point closely adjacent the back wall 10 but not forming a depression in the back wall 10 itself. The depression 18 has side wall surfaces 20 and a back wall surface 22 which are formed so as to closely accommodate the distal end 24 of a down spout.

The rear wall 10 includes a portion 26 having the shape of an inverted T. The portion 26 is separate or easily separable from the remainder of the back surface 10. For example, the portion 26 may be separated by a cut or perforations 28 which may be stamped or otherwise formed on the rear surface 10, except adjacent the base 30 of the inverted T. The lateral ends of the inverted T may include holes 32 (four holes are shown however a larger or smaller number may be used).

Figure 3:
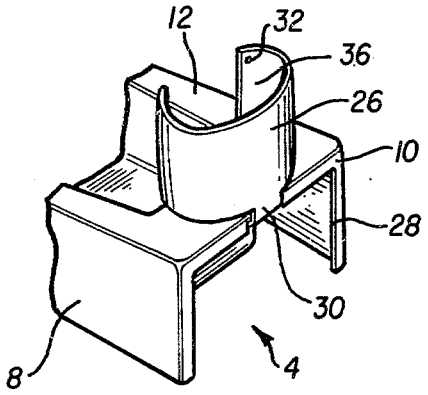
FIG. 3 is an orthogonal view of the rear portion of the run-off trough showing the inverted T shaped portion rotated 180° and the arms of the T bent as they would be when surrounding a down spout.

The body 2 is formed of a resiliently deformable plastic such as nylon, polyethylene, polyvinylchloride, polypropylene or ABS plastic so that the inverted T shaped portion 26 may be bent by 180° about the base 30 whereby the arms of the T extend above the top surface of the body 2 (see FIG. 3).

In use, the body 2 is positioned beneath the distal end 24 of a down spout with the distal end inserted and partially held by the depression 18. The portion 26 is then bent 180° about base 30 with perforation 28 which may exist between the surface 10 and the portion 26 having first been separated, until the arms of the T extend substantially vertically above the surface 12 and behind the vertical portion 34 of the down spout. The ends 36 of the T are then wrapped around the vertical portion 34 of the down spout and secured together with a vertical portion of the down spout held within the arms of the T. Tie strings such as strings 38 passing through holes 32 may be used for securing the ends 36 of the arms, however other securement means such as buckles or clamps may also be used.

Figure 4:
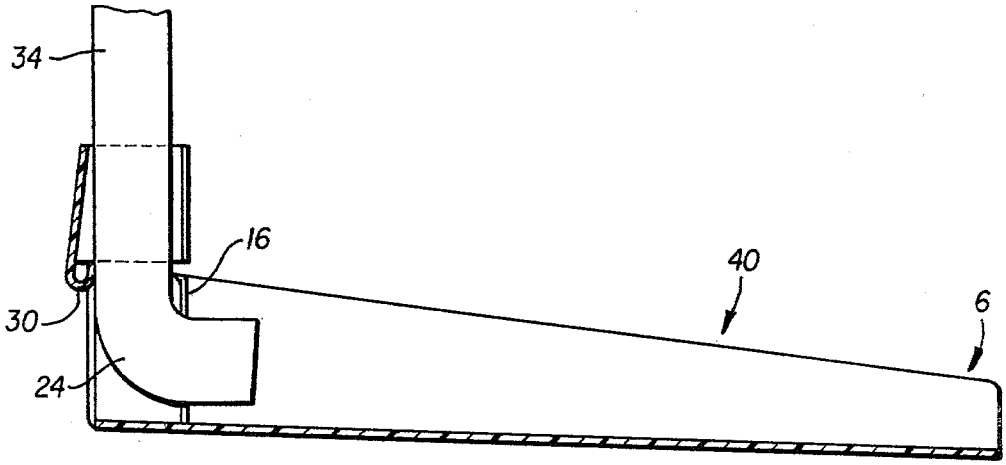
FIG. 4 is a front cross sectional view of the trough and down spout similar to that of FIG. 2.

Since the securement of the arms of the T to the vertical portion of the down spout is by the frictional engagement of the T to the down spout, downward forces on the body 2 resulting from a buildup of water within the trough will permit the trough to slide downward with respect to the down spout until the trough is securely supported by the ground, thereby eliminating the danger of overloading the supports of the down spouts. The resiliency of the base at 30 tends to cause the front end 6 of the body to rotate in the direction of the arrow 40 (FIG. 4), thereby holding the front end securely against the ground and avoiding the danger of the front end being lifted by wind gusts.

Figure 1:
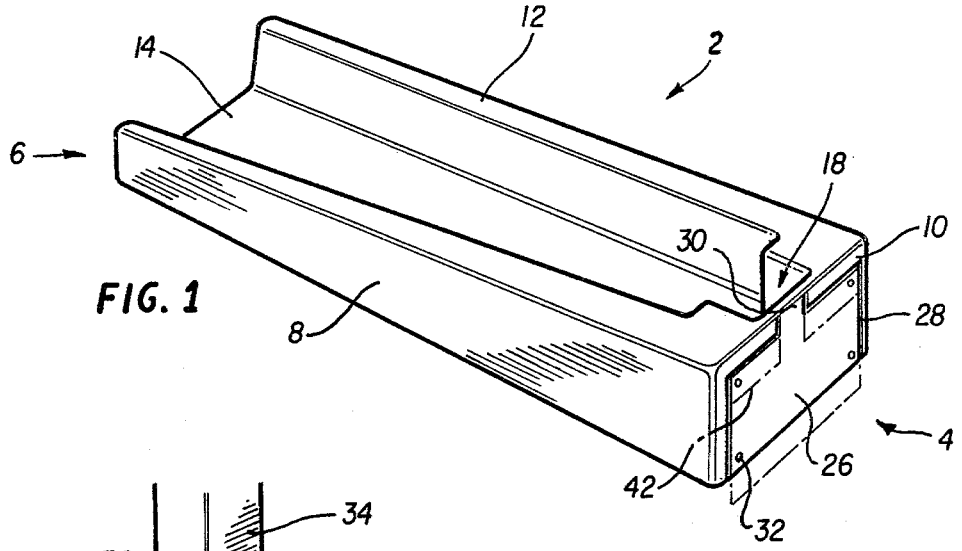
FIG. 1 is an orthogonal view of the run-off trough of the present invention, showing the rear wall surface and inverted T shaped portion thereon.
Figure 2:
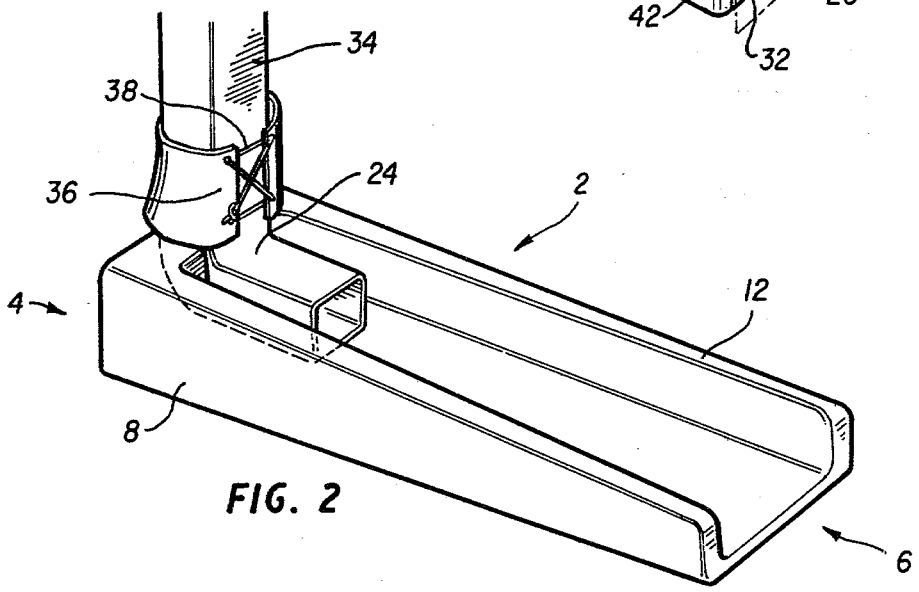
FIG. 2 is an orthogonal view of the run-off trough showing a down spout in the secured position.

The distal ends of down spouts are separated from the ground by varying distances and therefore the run-off troughs of the present invention can be manufactured in several models having differing proportions between the base and arms of the inverted T portion 26; that is, in some models designed for down spouts which are relatively far from the ground, the base 30 may be much longer than shown and the arms may be narrower than as shown in order to permit the arms to extend to the vertical portion of the down spout following the bending of the T shaped portion. The phantom lines 42 in FIG. 1 represent such an alternative model in which the base has been lengthened in order to accommodate down spouts which are further from the ground surface.

A related feature of the present invention is the provision that on some models, the bottom surface of the inverted T shaped portion 26 may be extended downwards as shown by the phantom lines 44 to accommodate down spouts whose distal ends terminate even further from the ground surface.

Although the down spout of the figures includes a distal end with an 90° bend, the present invention can accommodate a down spout having a vertical distal end without such a 90° bend.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A run-off trough for a down spout, comprising:

a hollow body having at least a rear end including a substantially vertical surface, a front end and a top surface;

a first depression in said top surface and forming a trough; and means on said substantially vertical surface for attaching said trough to a vertical portion of said down spout, wherein said means for attaching comprise a portion of said substantially vertical surface, said portion including arm means, and at least said arm means of said portion being separable from the remainder of said substantially vertical surface.

2. The run-off trough of claim 1 wherein said portion of said substantially vertical surface has the shape of an inverted T and wherein said entire portion is separable from the remainder of said substantially vertical surface except for the base of said T.

3. The run-off trough of claim 1 wherein the base of said inverted T is adjacent said top surface and the edge of the arms of said inverted T opposite said base forms the bottom edge of said substantially vertical surface.

4. The run-off trough of claim 1 or 3 including means on the lateral ends of the arms of said inverted T for holding said arms in a position wrapped around said vertical portion of said down spout.

5. The run-off trough of claim 4 wherein said means for holding comprise holes in the laterial ends of said arms, said holes adapted for permitting tying means to pass therethrough.

6. The run-off trough of claim 1 wherein the edge of said inverted T opposite said base extends below the bottom edge of said substantially vertical surface.

7. The run-off trough of claim 1 wherein said first depression extends from adjacent said rear end to said front end and wherein said first depression includes a substantially vertical rear surface adjacent said rear end, further comprising:

a second depression in said top surface, said second depression extending from said rear surface of said first depression towards said rear end, said second depression including a bottom surface, lateral side surfaces and a rear surface, all of which substantially conform to the distal end of said down spout.

8. The run-off trough of claim 1 or 7 wherein at least said portion of said substantially vertical surface is formed of resiliently deformable plastic material.

9. The run-off trough of claim 1 or 7 wherein said hollow body is formed of a resilient molded material.

10. The run-off trough of claim 8 wherein said portion of said substantially vertical surface is separable therefrom by means of a reduced wall thickness segment of said rear end, said reduced wall thickness segment having the shape of at least a part of said portion.

* * * * *